US007731671B2

(12) United States Patent
Ting et al.

(10) Patent No.: US 7,731,671 B2
(45) Date of Patent: Jun. 8, 2010

(54) MASSAGING DEVICE

(75) Inventors: Chuan-Chien Ting, Hsinchu (TW); Yung-Feng Nien, Hsinchu (TW); Shyuan Yueh Lin, Hsinchu (TW); Fei-Hsu Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 852 days.

(21) Appl. No.: 11/551,686

(22) Filed: Oct. 20, 2006

(65) Prior Publication Data

US 2007/0149907 A1 Jun. 28, 2007

(30) Foreign Application Priority Data

Dec. 23, 2005 (TW) ..... 94146340 A

(51) Int. Cl.
*A61H 7/00* (2006.01)

(52) U.S. Cl. ..... 601/99; 601/98; 601/101; 601/103

(58) Field of Classification Search ..... 601/86, 601/87, 90, 91, 93, 94, 95, 98, 99, 100, 101, 601/102, 103, 111, 112, 113, 115, 116, 126, 601/134

See application file for complete search history.

(56) References Cited

U.S. PATENT DOCUMENTS

| | | | | |
|---|---|---|---|---|
| 6,790,190 | B2 * | 9/2004 | Marcantoni | 601/99 |
| 7,022,092 | B2 * | 4/2006 | Shimizu et al. | 601/99 |
| 7,029,453 | B2 * | 4/2006 | Chen | 601/99 |

FOREIGN PATENT DOCUMENTS

| | | |
|---|---|---|
| TW | 123537 | 5/1997 |
| TW | 508237 | 11/2002 |
| TW | 578195 | 2/2004 |
| TW | M82676 | 12/2005 |

* cited by examiner

*Primary Examiner*—Quang D Thanh

(57) ABSTRACT

A massaging device particularly for a chair is provided. Owing to the provision of the rotative arms, the relative distance between the upper and lower massaging element pairs in the massaging device can be adjusted, and thus a massaging action imitating a human-made massaging action can be generated by the massaging device. Further, a relative protruding extent between the upper and lower massaging element pairs may be selected, and thus the foul-wheel or dual-wheel based pressing, rubbing and tapping actions can be provided when these massaging elements are operated with cooperation of a displacement mechanism and a control device. In addition, the provided massaging force can be adjusted to achieve a good massaging effect on the acupuncture points and strained muscles of the user.

17 Claims, 8 Drawing Sheets

MASSAGING DEVICE

FIELD OF THE INVENTION

The present invention relates to a massaging device. More particularly, the present invention relates to a massaging device which may be used on a chair's back.

BACKGROUND OF THE INVENTION

As the population pyramid indicates, the population aging problem has become more and more serious and thus old people are significantly increasing. Correspondingly, the old people care problem has to be concerned in a planned manner. To improve the chronic diseases and degeneration issues involved generally with the old people, massaging is widely suggested in both traditional Chinese and modern medical science since it may benefit blood circulation and metabolism, help remove some waste material in the body and fatigue and ache, and enhance resistance to diseases and natural cure ability. Consequently, many kinds of sport tools and massaging devices have been developed and hit the market. Chair back massaging device is one of such devices. Generally, the chair back massaging device has the massaging effects of robbing, rolling, tapping, pressing, kneading and vibrating and is thus popular for ordinary families.

Kneading with a massaging ball is a general feature in the chair back massaging device. However, one motor set can only drive a massaging ball set to operate. Although multiple motor sets may be used to drive a multiple of massaging balls to operate, the cost of the massaging device and the power therefore have to be increased. Further, since such massaging ball cannot provide the rubbing and kneading effects exercised from different angles and in an eccentric manner, it cannot be adjusted in the angles of depression and elevation according to actual needs. Even the multiple massaging balls may be concurrently driven by a motor set with two such balls exercising the kneading and robbing operations alternatively in a particular direction scheme, the massaging range provided thereby with respect to the user is still limited. Thus, such massaging device still has something to be improved.

For the current chair back massaging device, a vertically movable massaging element is disposed, with which the massaging effect is provided. In operation, the massaging device is contacted with a massaged portion, typically the back portion, of a user and supports the weight of the massaged portion of the user, enabling an inversely corresponding force to be generated. Thus, a massaging force is acted upon the user. Specifically, the massaging balls of the massaging device are driven to operate and thus provide the massaging effect to the back of the user. For conventional massaging balls in such massaging device, they are arranged vertically and the range acted by the massaging balls on the user's back is limited within a thickness range of the massaging balls. Hence, the overall massaged range on the user's back is also limited. Further, when the massaging device operates, the massaging balls roll and thus upward and downward forces are respectively generated on the user's back. Since only a few directions of rubbing effects are generated, the massaging effect is limited.

The current chair back massaging device may be categorized into a dual-wheel type, a four-wheel type and a multi-wheel type. In the dual-wheel type chair back massaging device, two massaging balls are used to support the weight of the to-be-massaged portion of the user. Since the weight is only supported by the two massaging balls, a larger massaging force is correspondingly generated and an improved massaging effect is acted upon the acupuncture points of the user. Further, since only the two massaging balls are involved in the massaging operation, this massaging operation is simple.

In the four-wheel type chair back massaging device, four massaging balls are used to support the weight of the to-be-massaged portion of the user. Referring to FIG. 1, one example, the Taiwanese patent TW508237, of such type of chair back massaging device is shown therein. As shown, the massaging device 102 has four massaging balls 101, an upper position changing device 103 and a lower position changing device 104. The upper and lower position changing devices 103, 104 are used to change the respective swing angles of the swinging arms 105, 106, so that the massaging device 102 may swing to provide a corresponding massaging effect. However, since the four massaging balls 101 are pinned down with each another, each of them merely has a narrow operative range.

In the multi-wheel type chair back massaging device, a multitude of massaging elements in different shapes are used to provide a diverse force arrangement on the user's back. However, since the massaging force is relatively smaller, the massaging effect on the acupuncture points of the user is relatively poorer. Further, since the multiple massaging balls are pinned down with each other, each of them only has a narrow operative range as well.

The chair back massaging device may also be categorized into a screw and connecting rod type, a pneumatic type and a gear and gear rack type in terms of the used displacement mechanism.

In the screw and connecting rod type massaging device, a drive source is used to drive the screw to rotate and thus the guide body to move laterally, causing the support arm mounted on the guide body to have a displacement with guidance by the connecting rod.

In the pneumatic type massaging device, a pushing force is generated by an air cushion when the air cushion inflates and the pushing force is used to push the swinging arm mounted on the connecting rod, enabling the upper and lower massaging elements to have a displacement with assistance of the connecting rod and the guide rail.

For the gear and gear rack type massaging device, it may be categorized into a straight-line displacement based type and an arc displacement based type. To see the straight-line displacement based type massaging device, refer to FIG. 2 in which the massaging device according to the Taiwanese Patent No. 576195 is shown. As shown, a drive source 6 is used to drive the gear to rotate under guidance of the fixed gear rack 52 on the frame 51. A motion transmission mechanism 65 is mounted between the displacement shaft 64 and the frame 51 for cooperation with the fixed gear rack 52. As such, the massaging device 76 on the moving shaft 67 is driven to move forward and backward along a straight line.

For the arc displacement based type massaging device, a drive source is used to drive the gear to rotate, with which the massaging element mounted on the fixed pivot is driven to have a rotative displacement with guidance of the arc gear rack on the frame.

For the currently existing chair back massaging device, the chair back generally has a rail in an S shape at the side contacted with the user, and does not provide a motion along a direction from the massaging device to the user and an inverse direction as compared thereto but only the motion along a length direction of the user so that the rail of the massaging device can be contacted with the back curve of the user. However, the S-shaped rail can not well contact with all back curves of different users, reducing the massaging effect provided by itself. In addition, such S-shaped massaging device without a displacement mechanism can not provide a pressing action and thus can not serve as a high-end product in the market.

Therefore, there is a need to provide a massaging device, particularly used for a chair back, which is free from the above-mentioned disadvantages. After a long intensive series of experiments and researches, the inventors finally set forth such a massaging device, particularly used for the chair back, which may effectively overcome the demerits existing in the prior art.

SUMMARY OF THE INVENTION

It is, therefore, an object of the present invention to provide a massaging device so as to improve the massaging modes and the massaging range provided by the prior art so that the massaging element of the massaging device may contact well with the back curve of a user.

In accordance with an aspect of the present invention, a swing mechanism of the massaging device is provided, which comprises a swinging arm having an end, at least two rotative arms each having an end connected pivotally to the end of the swinging arm, and at least two motion transmission mechanisms each having a movable shaft, mounted on both sides of the swinging arm and connected pivotally to a corresponding one of the at least two rotative arms respectively, for driving the at least two rotative arms to swing forward and backward.

In an embodiment, each of the at least two motion transmission mechanisms is a motor.

In an embodiment, each of the at least two motion transmission mechanisms is a hydraulic cylinder.

In an embodiment, each of the at least two motion transmission mechanisms is a pneumatic cylinder.

In an embodiment, each of the at least two motion transmission mechanisms is a solenoid.

In an embodiment, the at least two rotative arms swing forward and backward to generate a massaging action for imitating a human-made massaging action.

In an embodiment, the massaging device is mounted on a chair's back.

In accordance with another aspect of the present invention, a displacement mechanism for a massaging device is provided, which comprises a support, at least a rack mounted on the support, a drive gear set driving the at least a rack, a drive mechanism having a motor for driving the drive motor set, and at least a swinging mechanism connected pivotally to the rack to move forward and backward as the rack moves.

In an embodiment, the at least a swinging mechanism moves forward and backward as the rack moves to generate a massaging action for imitating a human-made massaging action.

In an embodiment, the massaging device is mounted on a chair's back.

In accordance with still another aspect of the present invention, a rubbing mechanism for a messaging device is provided, which comprises a support, a rubbing shaft mounted on the support, a drive mechanism having a motor for driving the rubbing shaft, and at least a swinging mechanism connected pivotally to the support to swing forward and backward as the rubbing shaft moves.

In an embodiment, the at least a swinging mechanism swings forward and backward as the rubbing shaft moves to generate a massaging action for imitating a human-made massaging action.

In accordance with yet another aspect of the present invention, a tapping mechanism for a massaging device is provided, which comprises a support, an eccentric shaft mounted on the support, a drive mechanism having a motor for driving the eccentric shaft, and at least a swinging mechanism connected pivotally to the eccentric shaft to move forward and backward as the eccentric shaft moves.

In an embodiment, the swinging mechanism moves forward and backward as the eccentric shaft moves to generate a massaging action for imitating a human-made massaging action.

In an embodiment, the massaging device is mounted on a chair's back.

In accordance with yet another aspect of the present invention, a massaging device is provided, which comprises a frame, a screw mounted on the frame, a drive motor mounted on the frame and driving the screw, and at least a displacement mechanism driven by the screw to slide up and down on the frame.

In an embodiment, the displacement mechanism comprises a swinging mechanism so as to generate a massaging action for imitating a human-made massaging action.

Other objects, advantages and efficacies of the present invention will be described in detail below taken from the preferred embodiments with reference to the accompanying drawings.

BRIEF DESCRIPTION OF THE DRAWINGS

The foregoing summary as well as the following detailed descriptions of the preferred embodiments are better understood when read in conjunction with the appended drawings. It is understood, however, that the invention is not limited to the specific methods disclosed or illustrated. In the drawings.

DETAILED DESCRIPTION OF THE PREFERRED EMBODIMENT

In the present invention, a massaging device, particularly for a chair back, is disclosed, which will be described below in detail, with the chair back used as an example for illustration, through the preferred embodiments with reference to the accompanying drawings.

Figure 1:
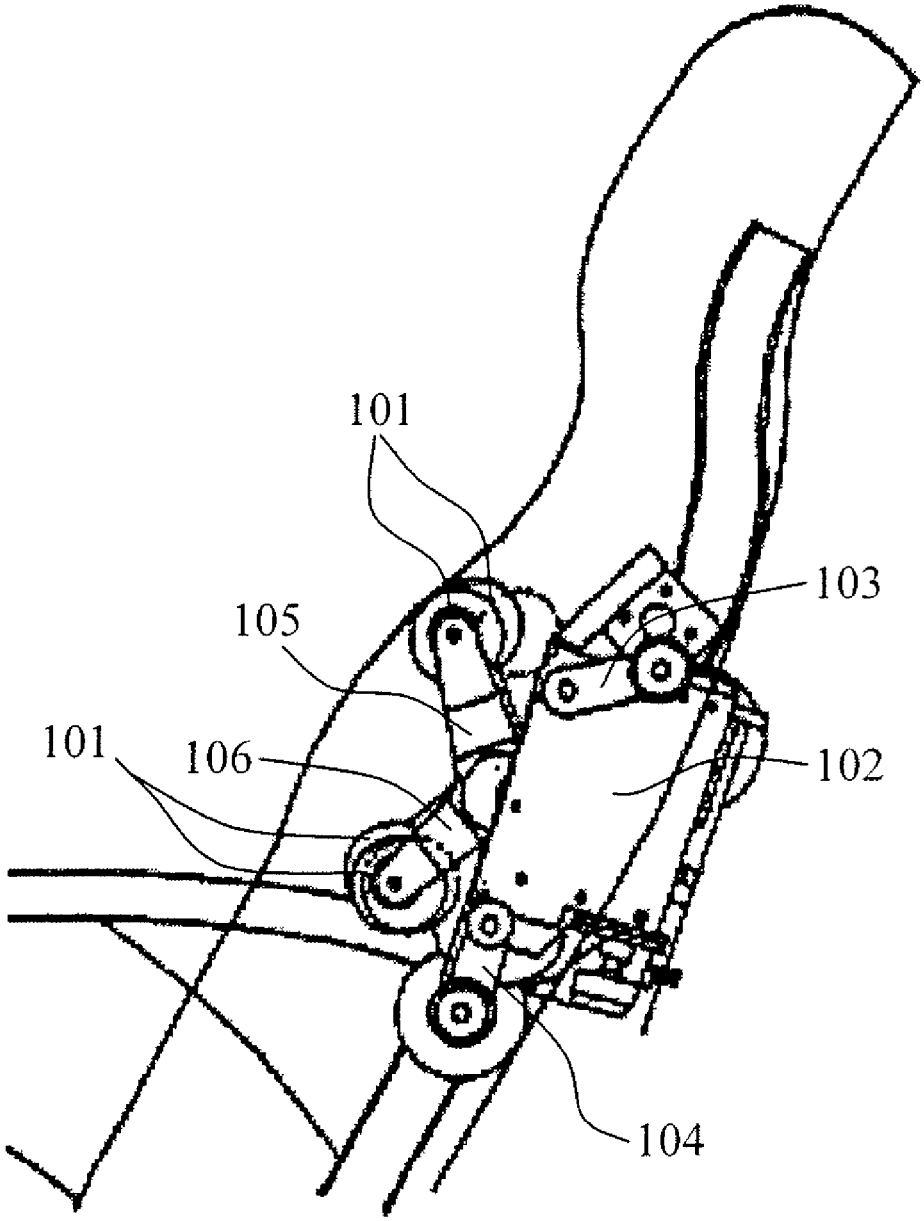
Fig. 1(PRIOR ART)
FIG. 1 is a schematic diagram of a conventional chair back massaging device.
Figure 2:
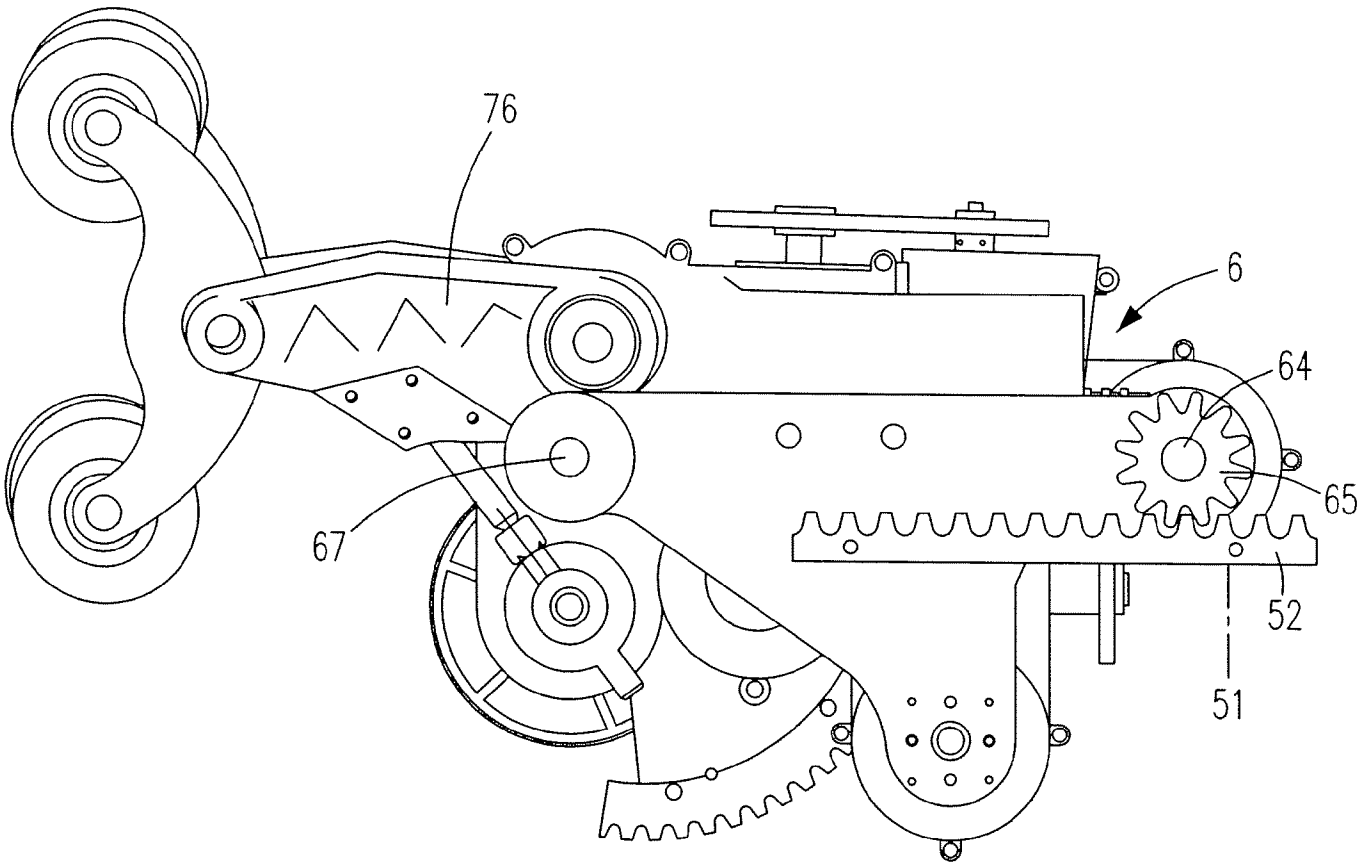
Fig. 2(PRIOR ART)
FIG. 2 is a schematic diagram of another conventional chair back massaging device.
Figure 3:
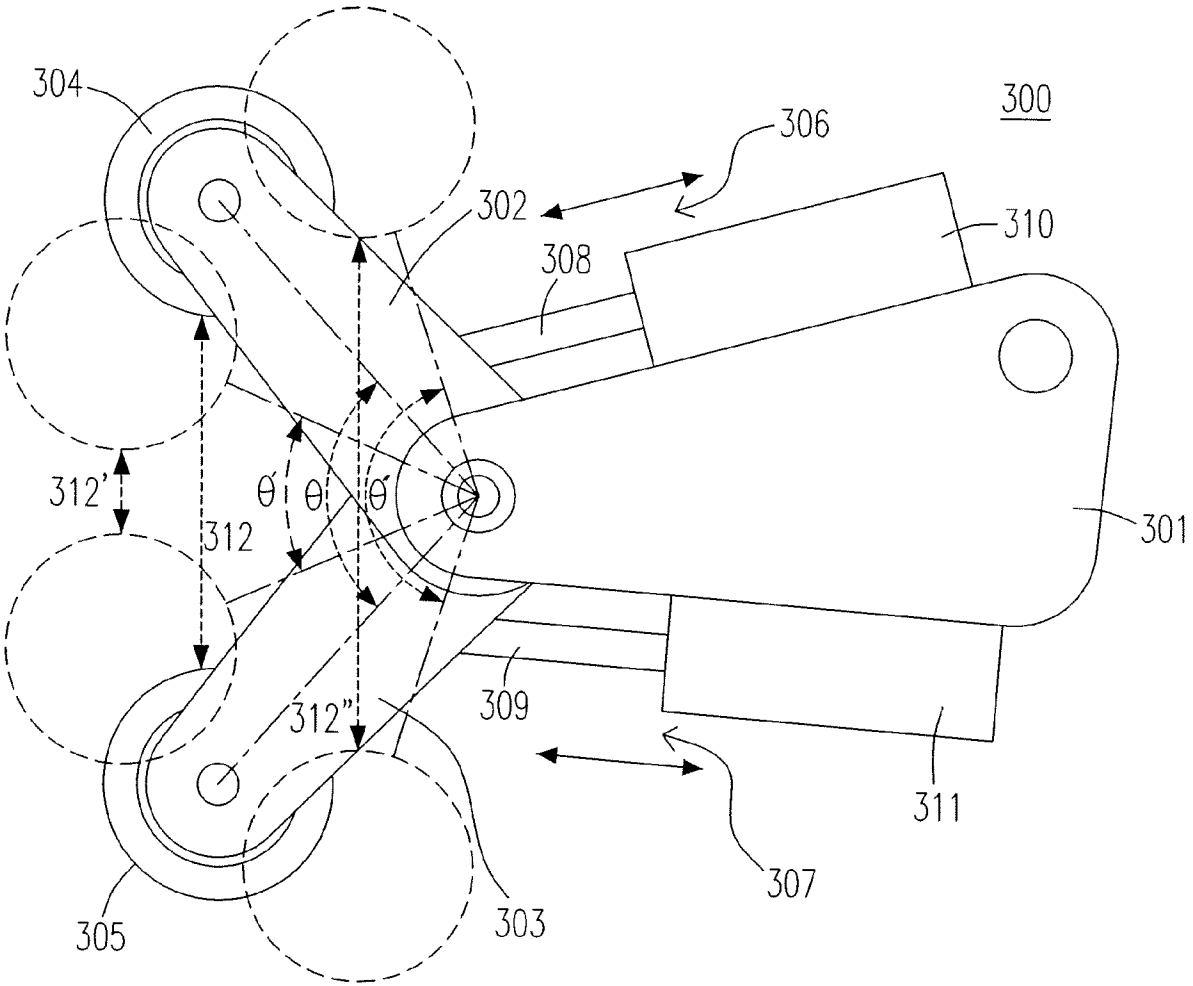
FIG. 3 is a schematic diagram of a swinging mechanism for a massaging device according to the present invention.

Referring to FIG. 3, a swinging mechanism of the massaging device according to the present invention is shown therein. The swinging mechanism 300 comprises a swinging arm 301, rotative arms 302, 303, massaging element pairs 304, 305 and motion transmission mechanisms 306, 307. Each of the massaging element pairs 304, 305 is composed of two massaging elements. Each of the motion transmission elements 306, 307 has a movable shaft 308 or 309 and an upper motion transmission element 310 or a lower motion transmission element 311. Each of the motion transmission elements 310, 311 is one of a motor, pneumatic cylinder, hydraulic cylinder and solenoid cylinder. The rotative arms 302 and 303 are connected to the swinging arm 301. Under control of the movable shafts 308 and 309 of the upper and lower motion transmission elements 310, 311, the swinging arm 301 is used to adjust a swinging angle θ between the rotative arms 302, 303 and a relative distance 312 and a relative protruding extent between the massaging element pairs 304 and 305.

Further to the above description with respect to the swinging arm 301, the swinging angle θ between the rotative arms 302, 303 and the relative distance 312 and the relative protruding extent between the massaging element pairs 304 and 305 are adjusted according to the following rule. When each of the movable shafts 308, 309 of the upper and lower motion transmission elements 310, 311 of the swinging arm 301 has a forward displacement concurrently, the relative distance 312' and the swinging angle θ' both become smaller. On the other hand, when each of the movable shafts 308, 309 of the upper and lower motion transmission elements 310, 311 of the swinging arm 301 has a backward displacement concurrently, the relative distance 312" and the swinging angle θ" both become greater. When the movable shafts 308, 309 move forward and backward repeatedly, the rotative arms 302, 303 generate a massaging action for imitating a human-made rubbing action.

Figure 4A:
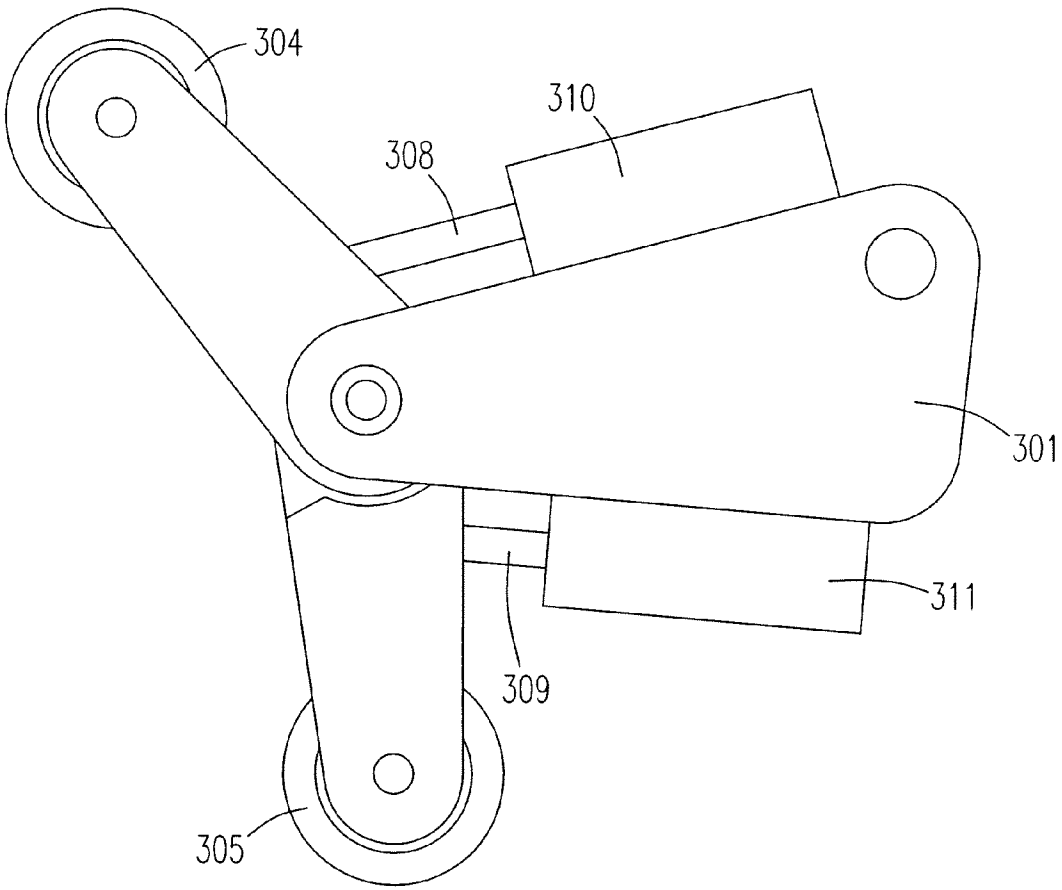
FIG. 4A and FIG. 4B are schematic diagrams of massaging element pairs of the massaging device having different relative protruding extents, respectively, according to the present invention.
Figure 4B:
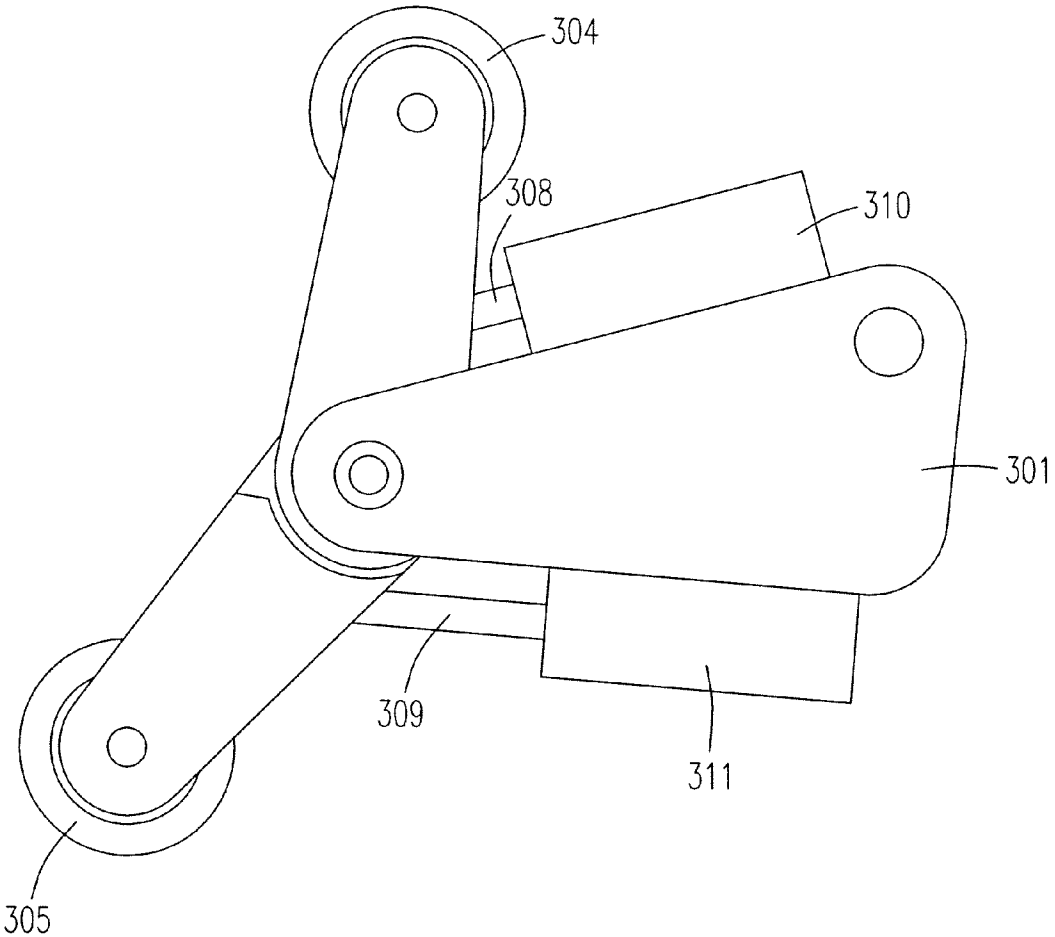

Referring to FIG. 4A and FIG. 4B, schematic diagrams of the massaging element pairs having different protruding extents from each other of the massaging device according to the present invention are respectively shown therein. When the movable shaft 308 of the motion transmission elements 310 has a forward displacement and the movable shaft 309 of the motion transmission element 311 has a backward displacement, the massaging element pair 304 has a greater protruding extent as compared to the massaging element pair 305, as shown in FIG. 4A. As such, the massaging action imitating the human-made rubbing action may be generated by the massaging device on the user's shoulders. On the other hand, when the movable shaft 308 of the motion transmission element 310 has a backward displacement and the movable shaft 309 of the motion transmission element 311 has a forward displacement, the massaging element pair 304 has a smaller protruding extent as compared to the massaging element pair 305, as shown in FIG. 4B. At this time, a massaging action imitating the human rubbing action can be generated by the massaging device on the user's hips.

Figure 5:
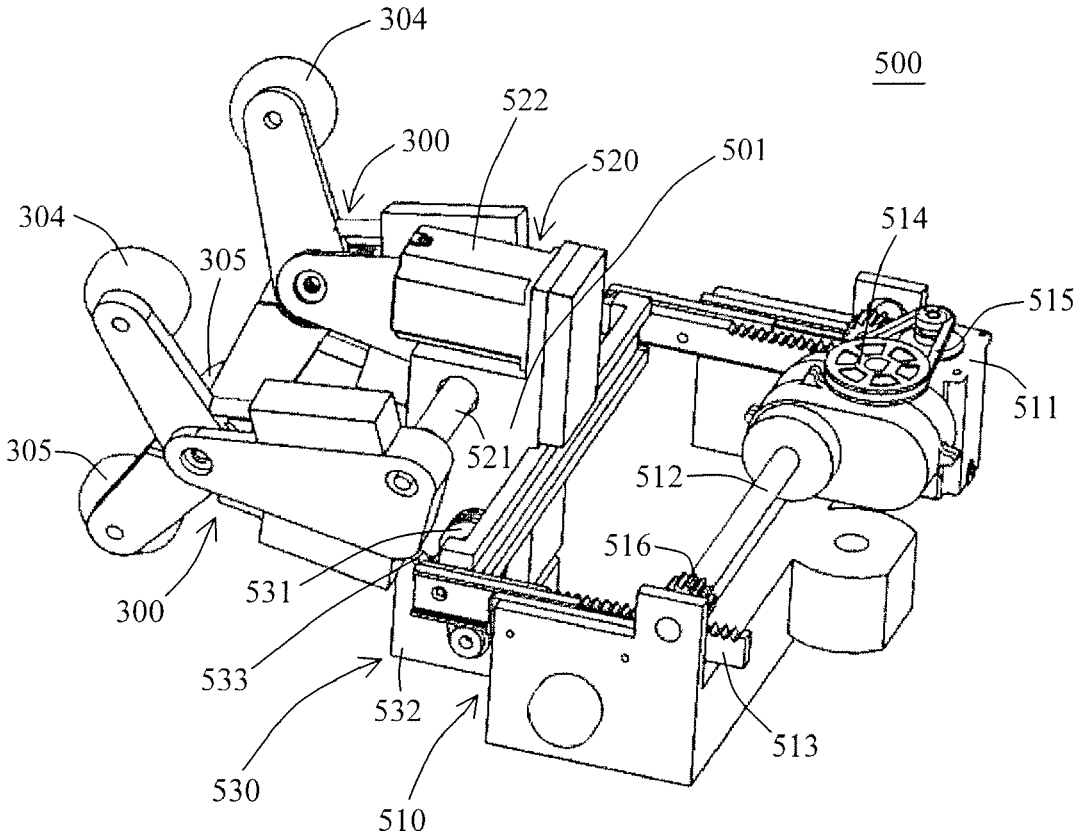
FIG. 5 is a schematic diagram of the massaging device according to the present invention.

Referring to FIG. 5, a schematic diagram of the massaging device according to the present invention is shown therein. As shown, the massaging device 500 comprises a support 501, a pair of swinging mechanisms 300, a displacement mechanism 510, a rubbing mechanism 520 and a tapping mechanism 530. The displacement mechanism 510 is connected to the support 501 and has a drive motor 511, a displacement shaft 512, a rack 513 and a gear set 514. The drive motor 511 drives the gear set 514 to rotate by means of a belt 515, causing the displacement shaft 512 to generate a displacement by means of a gear 516 rotating on the rack 513. As such, the respective massaging element pairs 304, 305 on the swinging mechanisms 300 generate a pressing action on the user.

The rubbing mechanism 520 has a rubbing shaft 521, through which the swinging mechanism 300 is pivotally connected to two sides of the support 501. Further, the rubbing shaft 521 is driven to rotate by a motor 522. As such, the respective massaging element pairs 304, 305 of the swinging mechanisms 300 generate a rubbing action on the user. The tapping mechanism 530 is pivotally connected to a side of the support 501 by means of an eccentric shaft 531, which is driven to rotate by a motor 532. When the eccentric shaft 531 rotates, a tapping arm 533 connected to the swinging mechanism 300 is also driven to operate concurrently. As such, the respective massaging element pairs 304, 305 on the swinging mechanisms 300 generate a tapping action on the user.

Figure 6A:
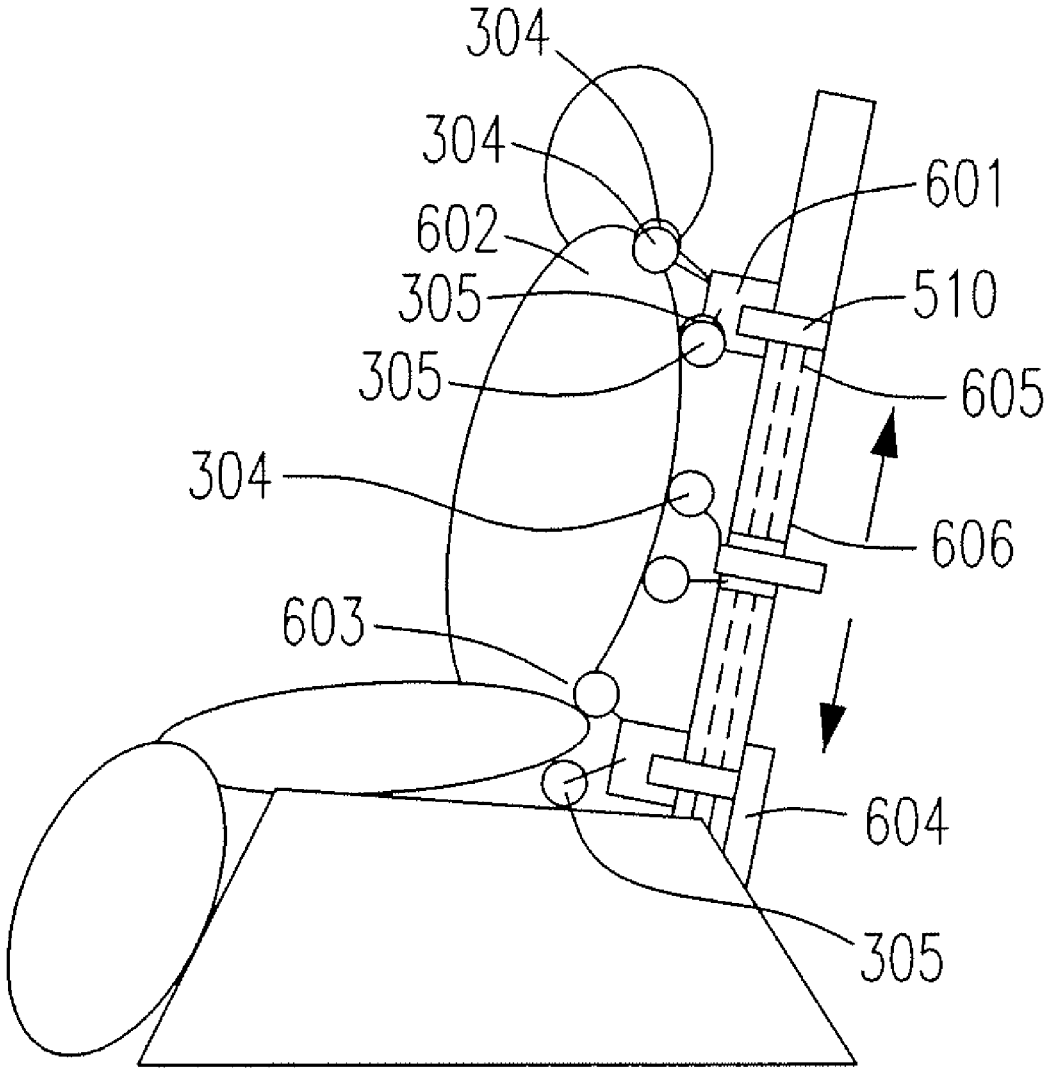
FIG. 6A and FIG. 6B are schematic diagrams of the massaging device when operating in a four-wheel mode and a dual-wheel mode, respectively, according to the present invention.
Figure 6B:
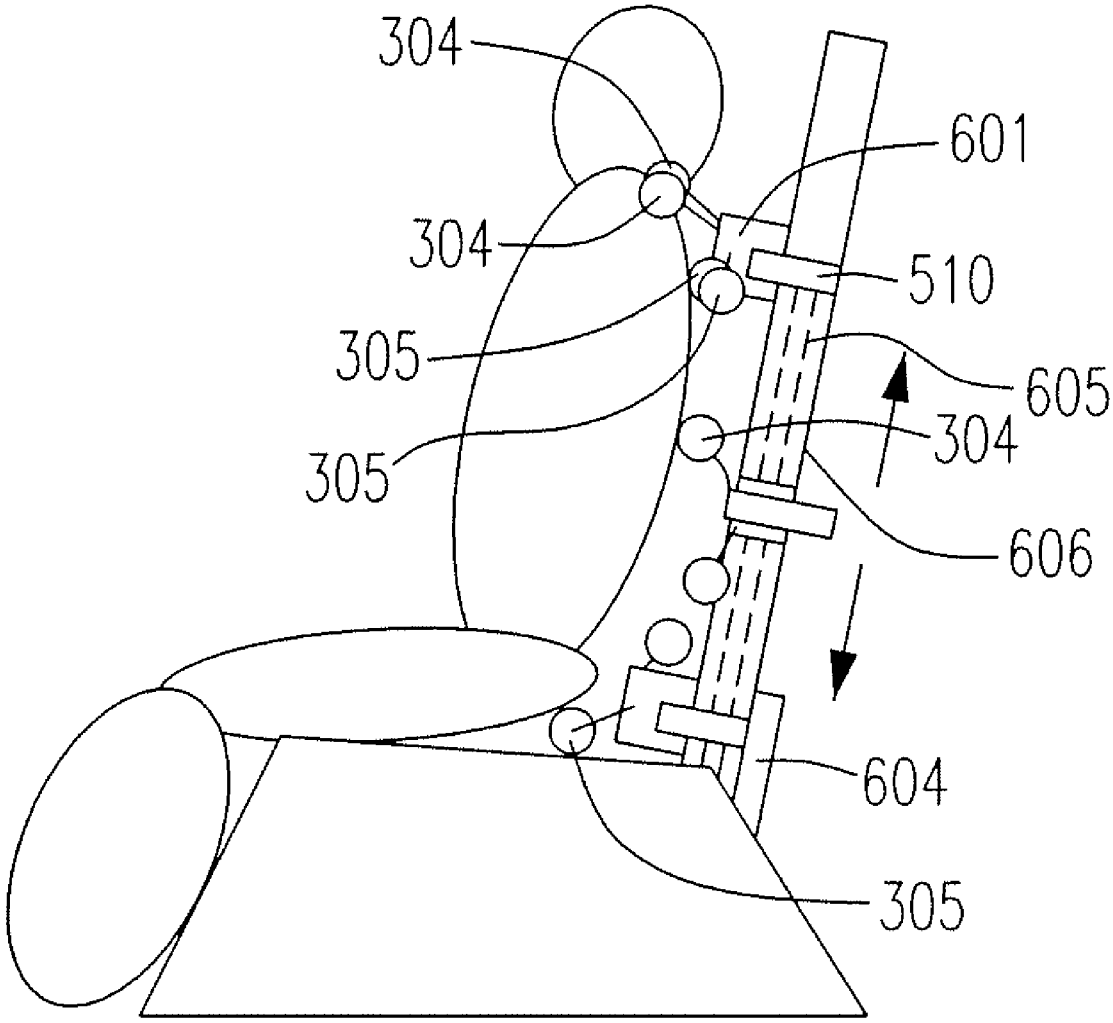

In the present invention, a four-wheel and dual-wheel operating modes may be provided by the massaging device, which will be illustrated with reference to FIG. 6A and FIG. 6B. As shown in FIG. 6A, a motor 604 is used to drive a screw 605 to slide the displacement mechanism 510 up and down along a frame 606. With cooperation of the displacement mechanism 510 and a drive device 601, a relative protruding extent between the massaging element pairs 304, 305 may be changed by the user so that the pressing, rubbing and tapping actions may be achieved in the four-wheel mode or the dual-wheel mode, where four massaging elements or only two massaging elements are used in the massaging operation. When the relative protruding extent between the massaging element pairs 304, 305 is relatively smaller, the massaging element pairs 304, 305 are used to support a weight of the massaged portion of the user. In this case, a softer and more uniform massaging force is acted on the massaged portion of the user. With cooperation of a micro-computer, the force may form a rubbing action on the shoulders 602 and the hips 603 of the user, as shown in FIG. 6A. This is how the four-wheel operating mode operates.

When the relative protruding extent between the massaging element pairs 304, 305 is relatively greater, only the massaging element pair 304 or 305 is used to support the weight of the massaged portion of the user. In this case, a greater massaging force is acted on the massaged portion of the user since the weight is supported by only the massaging element pair 304 or 305, and thus a better massaging effect on the acupuncture points of the user is achieved, as shown in FIG. 6B. This is how the dual-wheel operating mode operates.

In conclusion, owing to the provision of the rotative arms, the relative distance between the upper and lower massaging element pairs can be adjusted, and thus a massaging action imitating a human-made massaging action can be generated by the massaging device. Further, the relative protruding extent between the upper and lower massaging element pairs may be selected, and thus the four-wheel or dual-wheel based pressing, rubbing and tapping actions can be provided when these massaging elements are operated with cooperation of the displacement mechanism and the control device (described as a micro-computer in the above). In addition, the provided massaging force can be adjusted to achieve a good massaging effect on the acupuncture points and strained muscles of the user.

While the invention has been described in terms of what is presently considered to be the most practical and preferred embodiments, it is to be understood that the invention needs not be limited to the disclosed embodiments. For example, the respective numbers of the rotative arms, the motion transmission elements and the massaging element pairs may be more than two. In addition, the present invention also contemplates more than one of the displacement mechanism. As a matter of fact, the inventive massaging device may be used with any article other than the chair back as long as the massaging effect can be effectively provided. Therefore, it is intended to cover various modifications and similar arrangements included within the spirit and scope of the appended claims, which are to be accorded with the broadest interpretation so as to encompass all such modifications and similar structures.

What is claimed is:

1. A swing mechanism of a massaging device, comprising:

a swinging arm having an end;

at least two rotative arms each having an end connected pivotally to the end of the swinging arm; and at least two motion transmission mechanisms each having a movable shaft, mounted on both sides of the swinging arm and connected pivotally to a corresponding one of the at least two rotative arms respectively, for driving the at least two rotative arms to swing forward and backward.

2. The swing mechanism as claimed in claim 1, wherein each of the at least two motion transmission mechanisms is a motor.

3. The swing mechanism as claimed in claim 1, wherein each of the at least two motion transmission mechanisms is a hydraulic cylinder.

4. The swing mechanism as claimed in claim 1, wherein each of the at least two motion transmission mechanisms is a pneumatic cylinder.

5. The swing mechanism as claimed in claim 1, wherein each of the at least two motion transmission mechanisms is a solenoid.

6. The swing mechanism as claimed in claim 1, wherein the at least two rotative arms swing forward and backward to generate a massaging action for imitating a human-made massaging action.

7. The swing mechanism as claimed in claim 1, wherein the massaging device is mounted on a chair's back.

8. A displacement mechanism for a massaging device, comprising:

a support;

at least a rack mounted on the support;

a gear set driving the at least a rack;

a drive mechanism having a motor for driving the gear set; and at least a swinging mechanism as claimed in claim 1 connected pivotally to the rack to move forward and backward as the rack moves.

9. The displacement mechanism as claimed in claim 8, wherein the at least a swinging mechanism moves forward and backward as the rack moves to generate a massaging action for imitating a human-made massaging action.

10. The displacement mechanism as claimed in claim 8, wherein the massaging device is mounted on a chair's back.

11. A rubbing mechanism for a messaging device, comprising:

a support;

a rubbing shaft mounted on the support;

a drive mechanism having a motor for driving the rubbing shaft; and at least a swinging mechanism as claimed in claim 1 connected pivotally to the support to swing forward and backward as the rubbing shaft moves.

12. The rubbing mechanism as claimed in claim 11, wherein the at least a swinging mechanism swings forward and backward as the rubbing shaft moves to generate a massaging action for imitating a human-made massaging action.

13. A tapping mechanism for a massaging device, comprising:

a support;

an eccentric shaft mounted on the support;

a drive mechanism having a motor for driving the eccentric shaft; and at least a swinging mechanism as claimed in claim 1 connected pivotally to the eccentric shaft to move forward and backward as the eccentric shaft rotates.

14. The tapping mechanism as claimed in claim 13, wherein the swinging mechanism moves forward and backward as the eccentric shaft moves to generate a massaging action for imitating a human-made massaging action.

15. The tapping mechanism as claimed in claim 13, wherein the massaging device is mounted on a chair's back.

16. A massaging device, comprising:

a frame;

a screw mounted on the frame;

a drive motor mounted on the frame and driving the screw; and at least a displacement mechanism as claimed in claim 8 driven by the screw to slide up and down on the frame.

17. The massaging device as claimed in claim 16, wherein the displacement mechanism comprises a swinging mechanism so as to generate a massaging action for imitating a human-made massaging action.

* * * * *